US005353536A

United States Patent [19]

Erber et al.

[11] Patent Number: 5,353,536

[45] Date of Patent: Oct. 11, 1994

[54] DISPLAY ASSEMBLY

[75] Inventors: Roger Erber, Mount Prospect; Jonathan E. Kane, Chicago, both of Ill.

[73] Assignee: Kane Graphical Corporation, Chicago, Ill.

[21] Appl. No.: 937,237

[22] Filed: Aug. 28, 1992

[51] Int. Cl.[5] ..... G09F 7/02

[52] U.S. Cl. ..... 40/611; 40/157

[58] Field of Search ..... 40/152, 152.1, 156, 40/157, 611, 642, 158.1

[56] References Cited

U.S. PATENT DOCUMENTS

| | | | |
|---|---|---|---|
| 2,190,557 | 2/1940 | Connell | 40/152 |
| 3,918,187 | 11/1975 | Vogele | 40/152.1 X |
| 4,385,744 | 5/1983 | Sherman et al. | 40/152.1 X |
| 4,583,309 | 4/1986 | Kane et al. | 40/152.1 X |
| 4,750,282 | 6/1988 | Zennedjian | 40/152 |

FOREIGN PATENT DOCUMENTS

| | | | |
|---|---|---|---|
| 1550374 | 11/1968 | France | 40/156 |

*Primary Examiner*—Clifford D. Crowder
*Assistant Examiner*—Paul C. Lewis
*Attorney, Agent, or Firm*—Wallenstein, Wagner & Hattis, Ltd.

[57] ABSTRACT

A sealed display assembly for displaying a sign or sheet poster includes a front cover frame mounted over the rear member and having a front vertical wall with a viewing opening therein, and top, bottom and side peripheral walls extending rearwardly from said respective margins of said front wall and shaped and sized to interfit with forwardly extending peripheral walls of the rear member. A compressible sandwich of elements includes a sign or poster-forming sheet fit between the cover frame and rear member. It includes an imperforate transparent panel mounted behind the front wall of the cover frame, the poster or sign-forming sheet mounted behind the panel wall of the cover frame, a compressible sealing gasket along the margins of the rear surface of the panel and extending around and sealing the sheet, and a body of compressible material behind the sheet and pressed by the cover frame against the rear member. The cover frame is locked into a position over the rear member by a tool which fits through an aperture in the bottom of the cover frame and engages a rotatable fastening device to lock and unlock the cover frame.

21 Claims, 5 Drawing Sheets

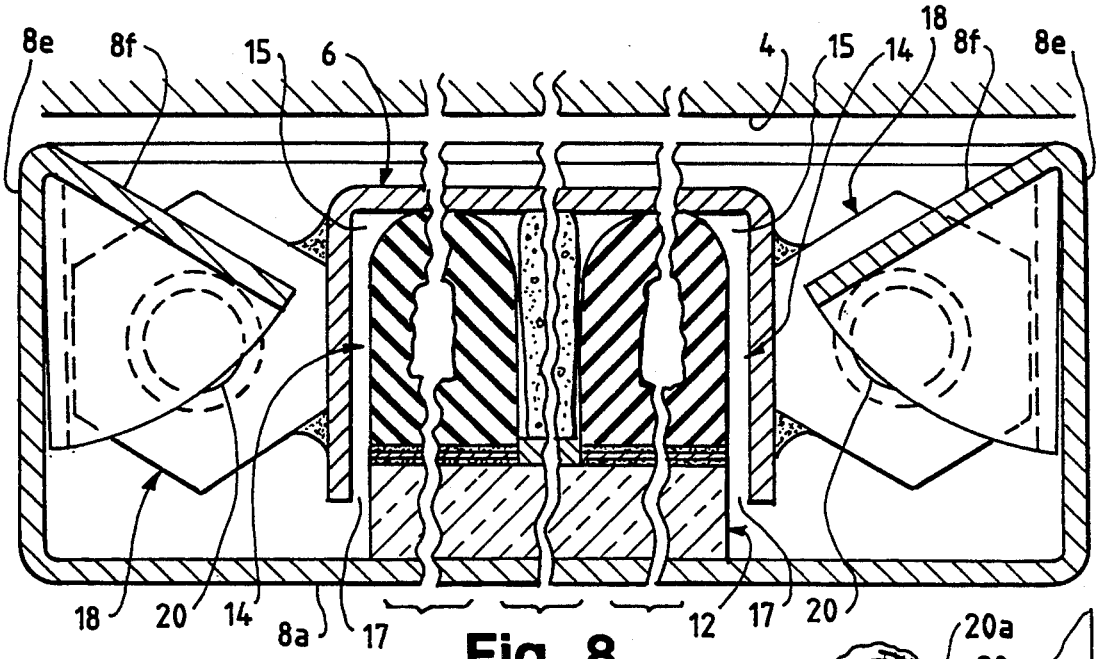
Fig. 8
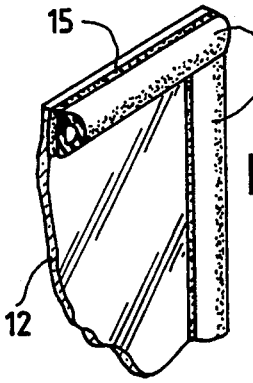
Fig. 9
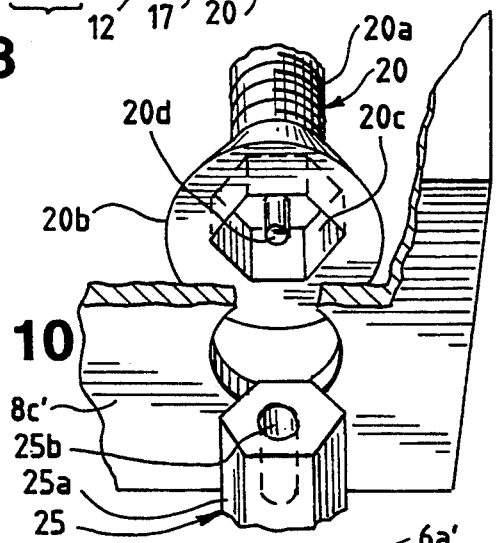
Fig. 10
Fig. 11
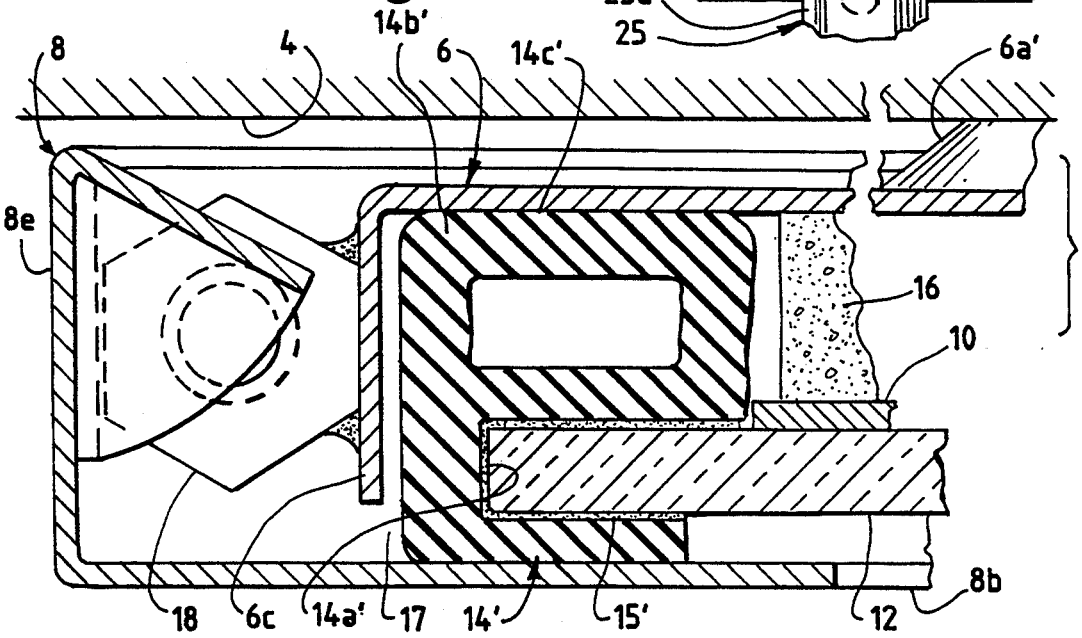

Fig. 14
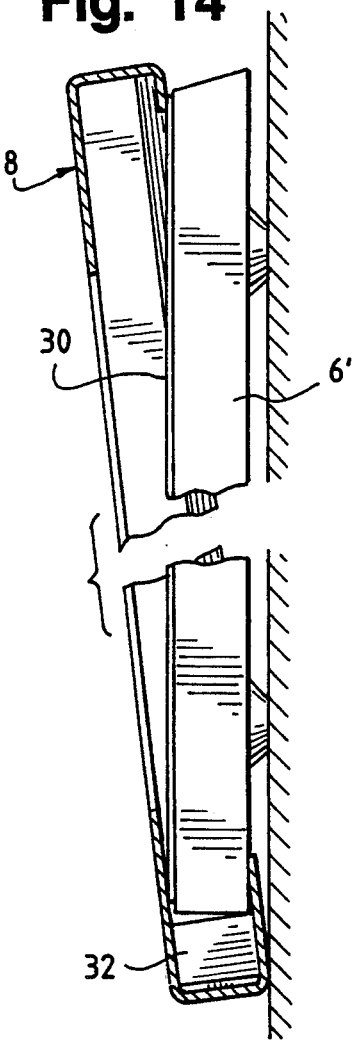
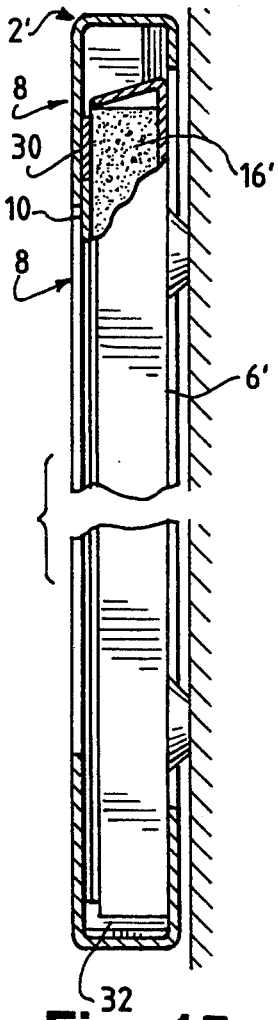
Fig. 15
Fig. 16
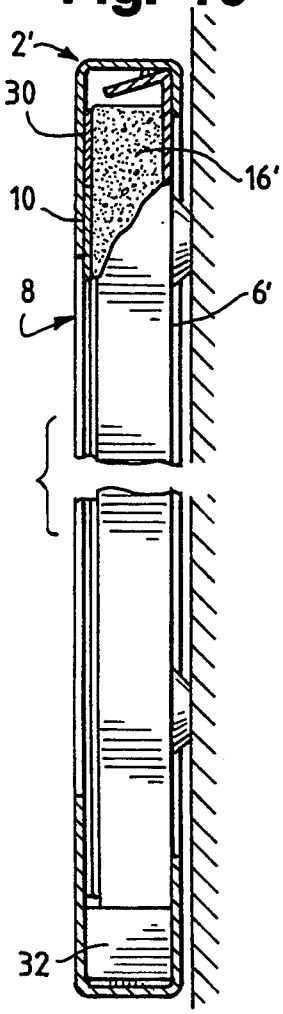
Fig. 17
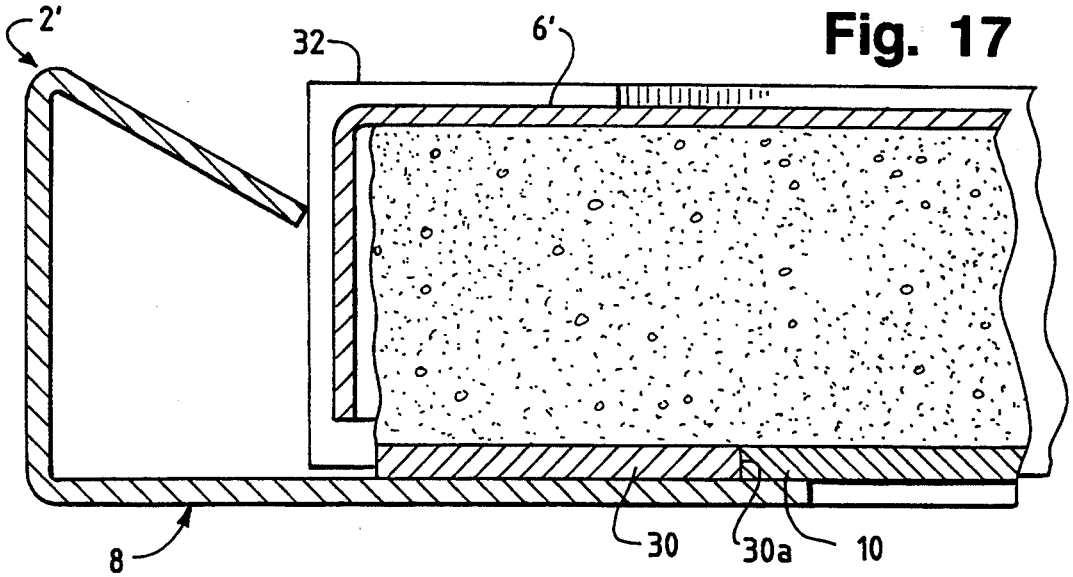

DISPLAY ASSEMBLY

TECHNICAL FIELD OF THE INVENTION

The technical field of the invention is the display art, and in particular outdoor and indoor poster or sign display sign assemblies. The outdoor version of the invention is designed to be tamper resistant and weather proof.

BACKGROUND OF INVENTION

It is commonly experienced that posters or signs are frequently defaced, obliterated, or removed by vandals. Such vandalism cannot effectively be prevented simply by enclosing the poster or sign within a frame having a transparent window and fitted together by easily visible fastening means. Moreover, a problem is presented to the designer of such units in that, not only must it be at least tamper-resistant with respect to vandals, but it should be a relatively simple matter for untrained personnel to remove the old poster from the display housing and replace it with a new one.

Such a sign assembly should also be inexpensive to fabricate, and further be configured to provide adequate rain protection to the display contents, e.g. a poster, when placed in outdoor locations. Although a key-lockable pivoted transparent door covering a sign-containing open front box-like structure may be employed for such purposes, such assemblies are costly, and the locks are readily susceptible to freezing in cold weather.

One solution to the above mentioned problems is disclosed in said U.S. Pat. No. 4,583,309. This patent discloses a tamper and rain water resistant display assembly designed to accept two-dimensional articles, e.g. posters and display signs. It comprises two major components held to each other by preferably magnetic holding means and separable from each other by use of a specially configured tool. In the preferred form of the invention, these two major components include a generally rectangular wall-mountable rear shroud-forming component having forwardly extending walls forming a rectangular insertion aperture, and a front rectangular cover frame having a generally centrally disposed transparent viewing window sealingly affixed therebehind. In the preferred form of the invention, a sign or poster-retaining means is affixed to the rear of the cover frame between two opposing sides thereof and preferably provides an insertion channel or pocket behind the viewing window. Into this pocket is slid an assembly preferably comprising a sign or poster and suitable backing sheets therebehind, to be captively retained in position behind the window by the retaining means. The inserted assembly preferably includes a compressible sheet, such as polyurethane foam, and a rigid backing board to press the poster or sign flat against the window. This materially assists in preventing wrinkling of the poster or sign under high humidity conditions.

Attached to the cover frame are frame holding means preferably configured to present rearwardly facing surfaces to confront complementary forwardly facing surfaces of holding means on the periphery of the shroud-forming frame when the cover frame is slidingly inserted into the insertion aperture thereof. These holding means are preferably magnetic means. A weather sealing strip means may be mounted on confronting peripheral faces of these front and rear display components to provide a seal against the elements.

The present invention provides a tamper proof resistant and rain water sealed display assembly which is superior to that disclosed in U.S. Pat. No. 4,583,309, among other reasons, in that it is of a more simple and low cost construction and provides a more effective water-tight seal for the poster or sign displayed therein.

SUMMARY OF THE INVENTION

In accordance with one of the features of the present invention, the rain water-proof display assembly of the invention comprises a rear wall-mountable sign or poster-receiving member, preferably in the shape of a rectangular pan. This rear member has a main vertical wall with forwardly extending peripheral top, bottom and side walls defining a poster or sign-receiving insertion aperture. The vertical wall is preferably securable to a vertical support surface by anchoring screws passable through apertures in the vertical wall.

The insertion aperture of the vertical wall of the rear pan-shaped member receives a compressible sandwich of elements of an overall size to fit within the insertion aperture. This sandwich of elements comprises an imperforate transparent panel or lens having compressible gasket strips forming what is sometimes referred to as a compressible sealing gasket secured along the marginal portions of the rear face of the panel and defining a water-sealed poster or sign-receiving space within the inner margins of the strips, a poster or sign-forming sheet positioned in this space and a compressible pad also sometimes referred to as a body of compressible material located behind this sheet and confronting the vertical wall of the rear member. This sandwich of elements may be spaced from the peripheral side walls of the rear member, so that water-draining passageways are provided outside of the gasket strips, to drain any water which may gain access to the interior of the display assembly outside of these strips. Drain holes are provided at the bottom of the display assembly so that water can drain therefrom.

This sandwich of elements is inserted into the rear member through the insertion aperture thereof and then pressed against the front surface of the vertical wall of the rear member by a cover frame which interlocks with the rear member. The gasket strips secured to the margins of the transparent panel are pressed and expanded against the outer face of the vertical wall of the rear member, to form a water-tight ring around the poster or sign-forming sheet. The cover frame has a front peripheral wall with a poster or sign viewing opening through which the sign or poster is visible through the transparent panel located behind the front wall of the cover frame.

Another feature of the invention, not necessarily requiring the above described features involves the unique manner in which the cover frame interfits with the peripheral and vertical walls of the rear member just described. Thus, in accordance with this aspect of the invention, the vertical wall of the rear member is configured so that, when it is mounted against a vertical support surface, at least the top and bottom margins thereof are spaced from the vertical support surface, to form flange-receiving spaces into which top and bottom locking flanges of the cover frame member can be extended. In the preferred form of the invention, these spaces are provided by flat, rearwardly projecting bosses formed as by indenting the otherwise flat front surface of the vertical wall of the rear member. These flat bosses engage the vertical support surface and space the rest of the vertical wall therefrom to an extent to permit preferably top and bottom cover frame flanges to be described to fit behind the vertical wall of the rear member when the cover frame is tilted with respect to a vertical plane during assembly of the cover frame on the rear walls. Anchoring screw-receiving apertures are provided in the vertical wall of the rear member which apertures are preferably formed in the boss-forming indented portions thereof, so that the anchoring screws are recessed within the front surface of this wall.

The cover frame has peripheral top, bottom and side walls extending rearwardly from the margins of the front wall thereof. The top and bottom peripheral walls terminate respectively in the previously described top downwardly extending and bottom upwardly extending flanges. The top and bottom peripheral walls and locking flanges of the cover frame are preferably spaced apart a distance such that when the cover frame is placed around the forwardly extending peripheral walls of the rear member, the cover frame can be vertically adjusted in position thereon. In the lowermost position of the cover frame, these flanges still interlock with and extend into the flange-receiving spaces behind the vertical wall of the rear member. In an uppermost portion of the cover frame, the top flange and top peripheral wall of the cover frame clear the upper margin of the rear member. The bottom peripheral wall of the cover frame has the aforesaid water drain holes. If the sealing gasket strips are spaced from the side peripheral walls of the rear member to provide water-draining passageways therebetween, the bottom peripheral wall thereof also is provided with water drain holes.

In accordance with a further feature of the invention, the cover frame is preferably locked in this lowermost position by a pair of locking bolts which have shanks which thread upwardly through vertical threaded apertures in stationary nuts welded or otherwise secured to the bottom of the side peripheral walls of the rear member. When the shanks of the bolts are partially unthreaded from the stationary nuts so that the heads of the nuts bear tightly against the top face of the bottom peripheral wall of the cover frame, the cover frame is locked in its lowermost position, where the top peripheral wall thereof seats upon the top peripheral wall of the rear member and the top and bottom locking flanges of the cover frame extend behind and interlock with the vertical wall of the rear member. The bottom peripheral wall of the cover frame has a tool-receiving aperture opposite a preferably specially shaped head of each locking bolt. A special tool with a shape complementary to the shape of the bolt head is insertable through each of these apertures to engage with the head of the adjacent bolt to tighten or loosen the same.

The sign assembly just described is for mounting outdoors. However, if the assembly is to be mounted indoors, where there is no need to have a water tight assembly protecting the poster or sign-forming sheet, the position of the latter sheet and the transparent panel are reversed, so that the sheet is in front of the transparent panel and engages the rear face of the front wall of the cover frame when the cover frame is applied to the rear member. Other aspects of the present invention have utility in a modified display assembly which is used only indoors, where there is no need for a waterproof tamper-resistant display. In such case, the features of the invention which involve the manner in which the cover frame interlocks with the rear member is still utilized. However, instead of stationary nuts and locking bolts which fold the cover frame in its lowermost position, a spring member is interposed between the top face of the bottom peripheral wall of the cover frame and the bottom face of the bottom peripheral wall of the rear member. In the process of applying the cover frame to the rear member, the bottom of the cover frame with spring member on the upper side of its bottom peripheral wall is compressed against the bottom face of the bottom peripheral wall of the rear member so that the top flange of the cover frame can clear the top margin of the rear member. When the cover frame is fully applied over the rear member, it is released. The spring then partially expands to press the bottom peripheral wall into a lowermost position where the cover frame is fully interlocked with the rear member.

Another feature of this only indoor version of the present invention is to replace the above described transparent panel and gasket strips by a frame-forming member made of any suitable material, for example, cardboard placed between the cover frame and the compressible pad. This frame-forming member has an opening into which the poster or sign-forming sheet is placed. The depth of the opening may be approximately the same as the thickness of the sheet. The assembly of this frame-forming member, poster or sign-forming sheet fitting inside the frame and the rear compressible pad forms a sandwich of elements compressed between the front wall of the cover frame and the vertical wall of the rear member.

The above described and other features of the invention will become apparent upon making reference to the specification to follow, the claims and the drawings.

DESCRIPTION OF DRAWINGS

FIG. 8 is an enlarged, broken-away horizontal sectional view through FIG. 1, taken along section plane 8—8;

FIG. 9 is a fragmentary perspective view of the upper lefthand corner of the transparent panel of the display assembly, showing the manner in which sealing gasket strips are secured to the marginal portions of the rear face of this panel;

FIG. 10 is a perspective bottom view of the display assembly of the invention, taken at the lower righthand corner of the display assembly shown in FIG. 1, and illustrating the manner in which a special tool is insertable through an aperture in the bottom peripheral wall of the cover frame, to engage with the head portion of a locking bolt to lock the cover frame into a lowermost position;

FIG. 11 is a view corresponding to FIG. 7, but with a modified sealing strip utilized in the assembly;

FIGS. 14–16 are views similar to FIGS. 4–6 showing the different steps in assembling the cover frame over the rear member for the modified form of the invention shown in FIG. 13; and FIG. 17 is an enlarged fragmentary horizontal sectional view through the display assembly of FIGS. 14–16.

DESCRIPTION OF EXEMPLARY FORM OF THE INVENTION SHOWN IN THE DRAWINGS

Figure 1:
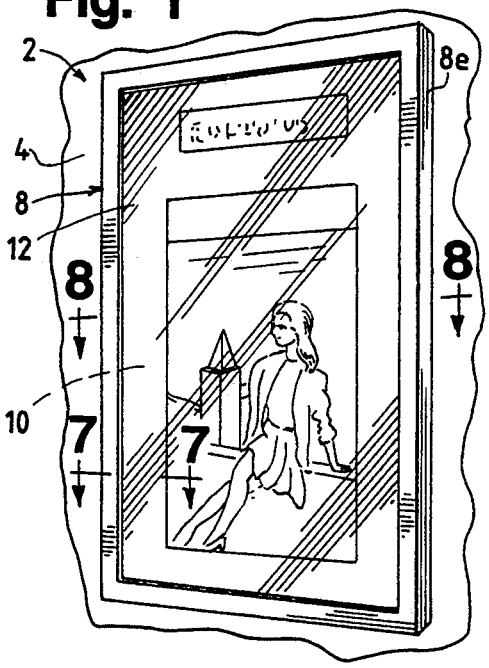
FIG. 1 is a perspective view of the display assembly of the present invention mounted on a vertical support surface.
Figure 2:
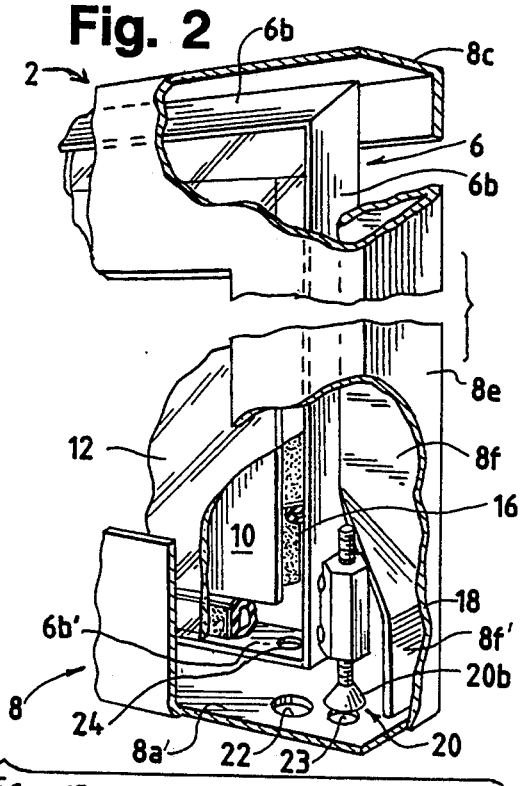
FIG. 2 is a perspective view of the upper right and lower right hand corners of the display assembly shown in FIG. 1, with the cover frame thereof broken away to show the details of the rear wall mountable member of the assembly around which the cover frame is mounted.
Figure 3:
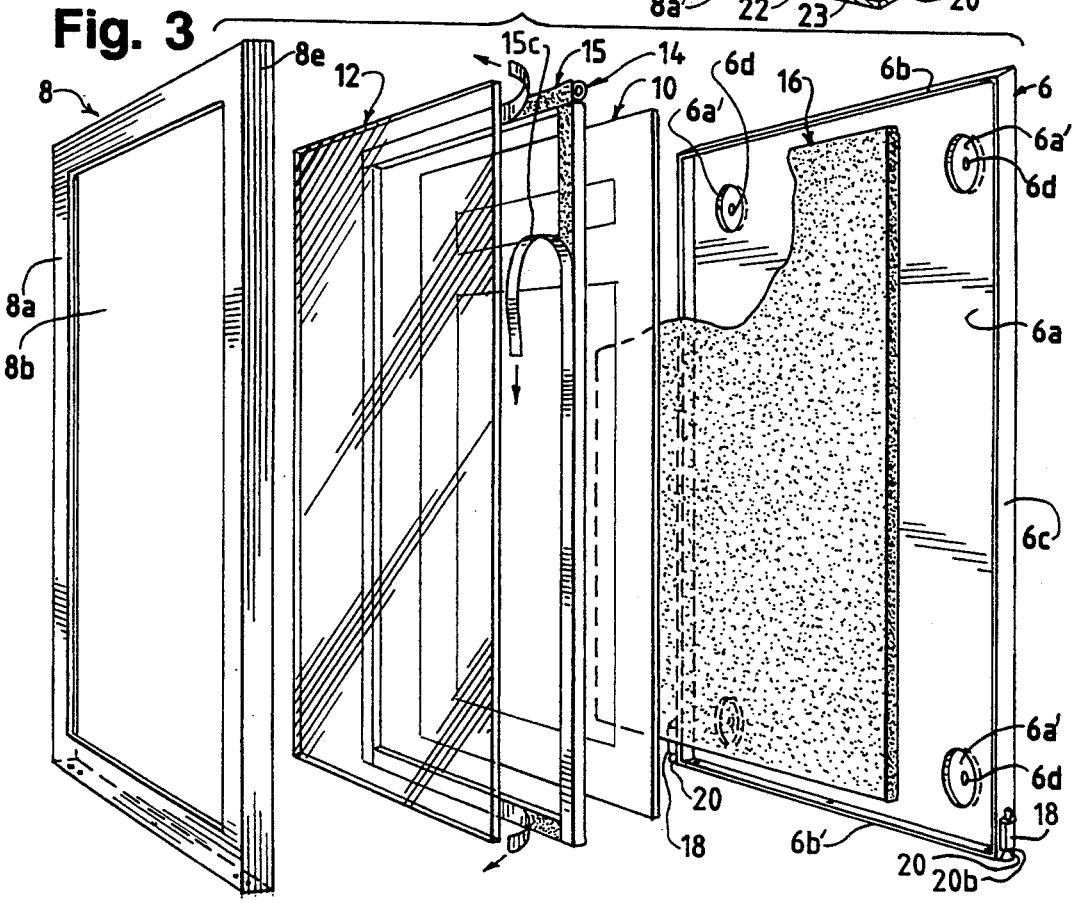
FIG. 3 is an exploded view of the different parts making up the display assembly of FIGS. 1 and 2.

Referring now to FIGS. 1–3, the display assembly of the invention there identified by reference numeral 2 is adapted to be mounted on a vertical support surface 4 shown in FIG. 1. The assembly includes a rear, pan-shaped, wall-mountable member 6, a front cover frame 8 and a sandwich of elements mounted between the cover frame 8 and the rear member 6. This sandwich of elements comprises a transparent panel 12 having secured to the marginal portions of the rear face thereof sealing gasket strips 14, a poster or sign-forming sheet 10 mounted within the confines of the sealing gasket strips 14, and a compressible pad 16.

In a manner to be described, the cover frame 8 extends around and interlocks with the rear member 6. When the cover frame 8 is interlocked with the rear member 6, the sandwich of elements is compressed between a front wall **8*a* of the cover frame 8 and the main vertical wall 6*a* of the rear member 6. The sealing gasket strips 14 form a water-tight seal around the sign or poster-forming sheet 10 and the compressible pad 16. The compressible pad 16 is then compressed by the pressure applied by the cover frame 8 and, in so doing, secures in place and flattens the sign or poster-forming sheet 10. The cover frame 8 is locked and placed upon the rear member 6 by normally invisible locking bolts and only accessible through tool pass-through apertures to be described located at the bottom of the cover frame 8**.

The rear member 6 may be secured to the vertical support wall 4 in a number of ways. It is preferred that the rear member be secured to the wall 4 by anchoring screws or the like (not shown) which pass through mounting screw-receiving apertures **6*d* formed in large circular indented wall portions 6*a*′ formed in the vertical wall 6*a* adjacent to the four corners of the rear member 6. The indented wall portions 6*a*′ form circular spacing bosses which engage the vertical support wall surface 4 and space the rest of the rear face of the vertical wall 6*a* from this vertical support wall surface. This provides locking flange-receiving spaces at the top and bottom margins of the rear member 6, so that the cover frame 8** can interlock with the rear member in a manner to be described.

Figure 7:
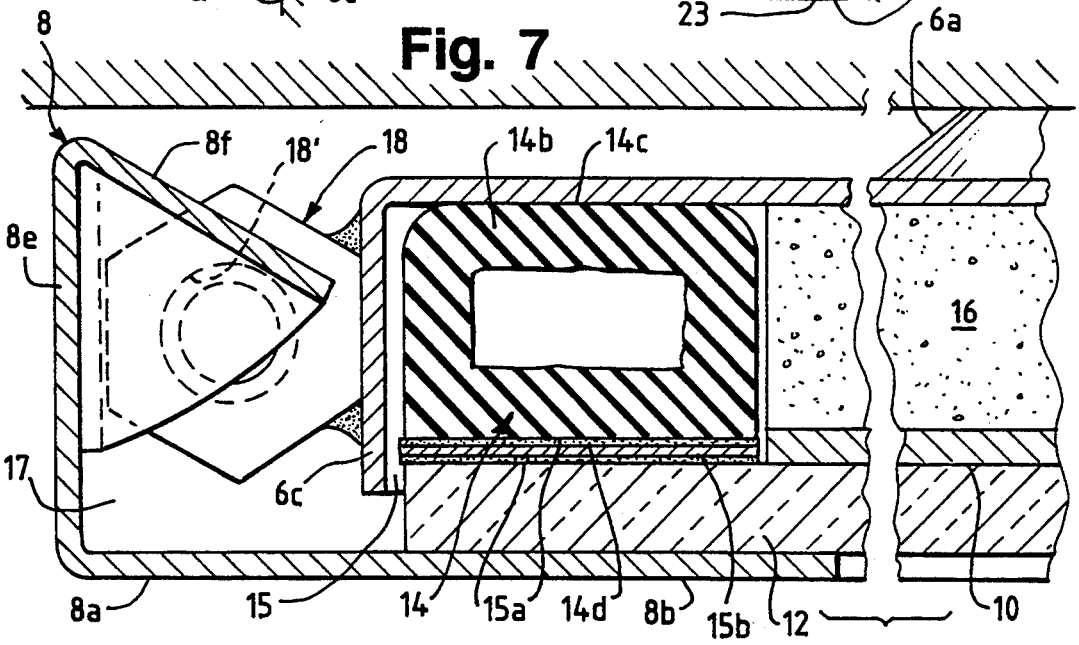
FIG. 7 is an enlarged fragmentary horizontal sectional view through FIG. 1, taken along section plane 7—7.

The pan-shaped rear member 6 has a forwardly extending downwardly inclining peripheral top wall **6*b*, vertical peripheral side walls 6*c*—6*c*, and a horizontal peripheral bottom peripheral wall 6*b*′. The top, bottom and side peripheral walls 6*b*—6*b*′ and 6*c*—6*c*′ define an insertion aperture into which fits the aforementioned sandwich of elements. In the preferred form of the invention, the side margins of the sandwich of elements are spaced inwardly a small distance from the vertical peripheral side walls 6*c*—6*c* of the rear member 6 to define water draining passageways 15′ (see FIG. 7**).

The cover frame 8 has top and bottom rearwardly extending, horizontal peripheral walls **8*c*—8*c*′ extending from the top and bottom margins of the front wall 8*a*, and rearwardly extending vertical peripheral side walls 8*e*—8*e* extending from the side margins of the front wall 8*a*. The front wall 8*a* has a large viewing opening 8*b* therein, through which can be viewed the sign or poster-forming sheet 10 through the transparent panel 12. The rear margin of the top horizontal peripheral wall 8*c* terminates in a downwardly extending vertical locking flange 8*d*, and the rear margin of the bottom horizontal peripheral wall 8*c*′ terminates in an upwardly extending vertical locking flange 8*d*′**.

Figure 4:
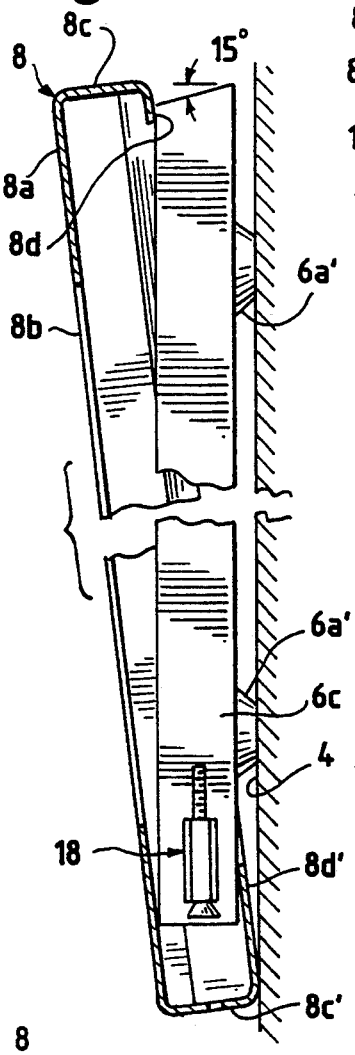
FIG. 4 illustrates the initial tilted position of the cover frame as it is being assembled onto the bottom margin of the rear member.

As shown in FIG. 4, during assembly of the cover frame 8 over the rear member 6, the cover frame is tilted so that the bottom locking flange **8*d*′ can be slipped behind the rear of the vertical wall 6*a* of the rear member 6. To this end, the bosses formed by the indented wall portion 6*a*′ of the vertical wall of the rear member 6 space the rear face of this wall from the vertical support surface 4 a distance several times the thickness of the locking flange 8*d*′ or 8*d*. This permits the cover frame to be tilted and the bottom locking flange inserted behind the vertical wall of the rear member. The downwardly and forwardly inclining top peripheral wall 6b of the rear member aids in guiding the movement of the cover frame 8 in its tilted position shown in FIG. 4 into a vertical position where it can fully interlock with the rear member 6**.

Figure 5:
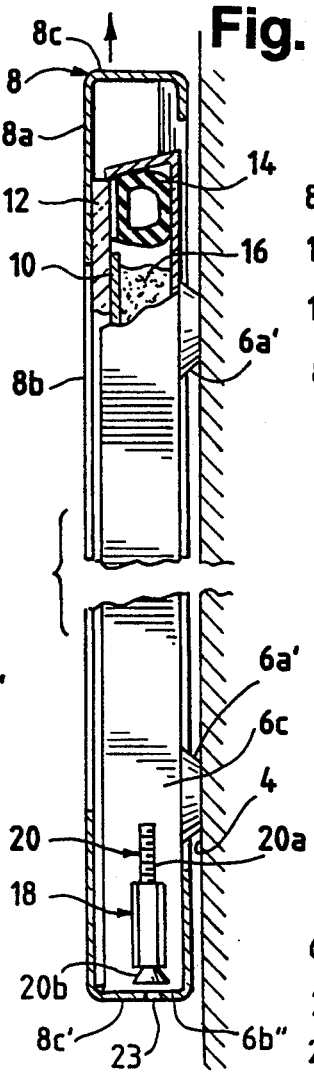
FIG. 5 is a view corresponding to FIG. 4, with the rear member partially broken away, and the cover frame in a fully raised vertical untilted position, where the top locking flange thereof is spaced above the upper margins of the rear member.
Figure 6:
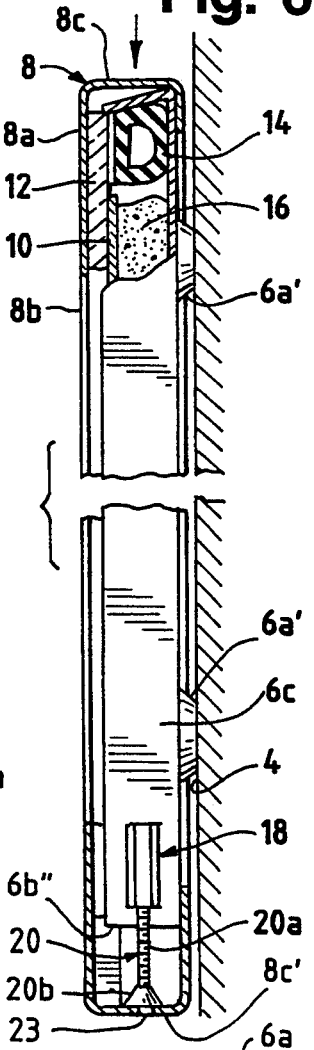
FIG. 6 is a view corresponding to FIG. 5 when the cover frame has been dropped into its lowermost position, and wherein locking bolts have been unthreaded to a point where the cover frame is locked into its lowermost position over the rear member.

The spacing between these flanges is much greater than the corresponding dimensions of the rear member, so that by raising the cover frame from its lowermost position shown in FIG. 4 to an uppermost position shown in FIG. 5, the top locking flange **8*d* will clear the top margin of the rear member 6 by a substantial amount. When the cover frame is then dropped to its lowermost position as shown in FIG. 6, the top locking flange 8*d* will engage the rear surface of the vertical wall 6*a* of the rear member 6 and the top horizontal peripheral wall 8*c* of the cover frame 8 will rest upon the uppermost margin of the vertical wall 6*a*. In this lowermost position of the cover frame 8 as shown in FIG. 6, while the bottom peripheral wall 8*c*′ of the cover frame is spaced a substantial distance below the bottom horizontal peripheral wall 6*d*′ of the rear member 6, the bottom locking flange 8*d*′ of the cover frame 8 still engages behind the vertical wall 6 of the rear member 6, as does the upper locking flange 8*d*. When the cover frame 8 is mounted over the rear member 6, the rear surface of the front wall 8*a* of the cover frame 8 engages and presses against the front face of the transparent panel 12. This, in turn, presses the pad 16 behind the sign or poster sheet 10 against the vertical wall 6*a* of the rear member 6**.

The inner faces of the side walls 8e—8e of the cover frame 8 are spaced a substantial distance from the rearwardly extending peripheral side walls 6c—6c of the rear member 6, to provide clearance spaces for stationary nuts 18—18 welded to the bottom ends of the peripheral side walls 6c—6c of the rear member 6. These stationary nuts 18—18 have threaded vertical bores 18' (FIG. 7) extending the full length thereof, to receive the threaded shanks 20a—20a of locking bolts 20—20. The locking bolts 20—20 have flat heads 20a—20a at the bottom thereof so that the heads can be moved to positions where they bear against the flat upper surface of the bottom horizontal peripheral wall 8c' of the cover frame 8, as best shown in FIGS. 6 and 10.

The peripheral side walls 8e—8e of the cover frame 8 have rear margins which terminate in forwardly inclining vertical centering flanges 8f—8f which terminate at a point contiguous to the outer faces of the peripheral side walls 6c—6c of the rear member 6, so that the cover frame 8 cannot move appreciably in a lateral direction when the cover frame is mounted over the rear member 6. The bottom ends of the centering flanges 8f—8f are deformed outwardly at 8f', as shown in FIG. 2, to provide clearance for the stationary nuts 18—18 secured to the bottom ends of the peripheral side walls of the rear member 6.

The bolts 20—20 are provided to lock the cover frame into its lowermost position as shown in FIG. 6. Initially, the bolts 20—20 are fully threaded into the nuts 18—18, so that the bolt heads are fully recessed above the bottom of the rear member 6. When the cover frame 8 is dropped to its lowermost position on the rear member 6 as shown in FIG. 6, the cover frame is locked into this lowermost position by unthreading the bolts 20—20 from the nuts 18—18 to an extent where the flat heads 20b—20b will bear down upon the upper face of the bottom peripheral wall 8c' of the cover frame 8. The bolt heads then prevent the cover frame from being raised to a position where the top locking flange 8d is above the top margin of the rear member where the cover frame can be pulled from the rear member.

The bottom peripheral wall 8c' of the cover frame 8 has tool-receiving apertures 23—23 in alignment with the heads of the bolts 20—20 so that a tool 25 shown in FIG. 10 can be inserted through each aperture 23 to enable the bolts to be unthreaded to the extent described. The head of the tool 25 is shown having a hexagonal profile to fit into a correspondingly hexagonally-shaped recess 20c formed in the head 20b of each bolt 20. Each bolt head 20b has a centered outwardly extending pin 20d adapted to fit into a correspondingly shaped aperture 25b in the tool head 25. This aperture 25b makes the hexagonally shaped head of tool 25 different from typical hex-head screw drivers. Thus, any conventional hex-head screw driver which is inserted through an aperture 23 will engage the bolt head pin 20d, so that it cannot be inserted within the bolt head recess 20c.

As previously explained, the sandwich of elements which fits between the front wall 8a of the cover frame and the vertical wall 6a of the rear member forms a unique water-sealed enclosure for the poster or sign sheet 10. Also, as will appear, even if water should gain entry into a space behind the transparent panel 12, this water cannot gain access to the sign or poster sheet 10.

The transparent panel 12 is an imperforate sheet of a suitable preferably synthetic plastic material which fits within the aperture defined by the peripheral walls 8c—8c' and 8e—8e of the cover frame 8 and the insertion aperture of the rear member. Secured along the top, bottom, and side margins of the rear surface of the transparent panel 12 are sealing gasket strips 14. As illustrated in FIG. 3, top and bottom gasket strips are provided to fit respectively along the top and bottom margins of the panel 12. These gasket strips each comprise a main hollow body 14b (see FIG. 7) made of a compressible rubber-like material. A double sided adhesive tape 15 having inner and outer adhesive layers 15a—15a carried on the opposite sides of a carrier layer 15a may be used to secure the gasket strips to the panel 12. The outer adhesive layer of each strip is exposed by peeling away the cover strips 15c (FIG. 3) from the rest of the tape. The adhesive tape is applied along a flat side 14d of each gasket strip. The application of the sealing gasket strips to the panel 12 is done by the fabricator of the display assembly, rather than by the customer. The customer receives the various parts making up the display assembly in an assembled or disassembled state without the poster or sign-forming sheet, which is supplied by the customer. (If the parts are disassembled, the packaged parts are referred to as a kit in the claims hereafter presented.)

The gasket strips 14 applied to the rear surface of the panel 12 form a water-sealing space for receiving the poster or sign-forming sheet 10 and the compressible pad 16 which, like the sheet 10, fits within the confines of the gasket strips 14. As previously indicated, when the sandwich of elements comprising the transparent panel 12 with the gasket strips applied to the rear face thereof, the poster or sign-forming sheet 10 and the compressible pad 16 are placed within the rear member 6, and the cover frame is applied over the rear member in a manner previously explained, the gasket strips 14 will be compressed against the front face of the vertical wall 6a of the rear member 6 to form a water-tight enclosure for the sheet 10 and the compressible pad 16. The pad 16 is also compressed by the cover frame 8 against the rear member 6.

FIG. 11 illustrates the use of a modified sealing gasket 14' applied to the marginal portions of the rear surface of the transparent panel 12. The sealing gasket 14' has a body portion forming a groove 14a' for receiving the periphery of the panel 12. A suitable adhesive 15' is placed between the panel 12 and the defining walls of the groove 14a' so that the gasket 14' is permanently affixed to the periphery of the panel 12.

In the forms of the invention using the gasket strips 14 or 14', when the cover frame 8 is applied over the rear member 6, the outer faces of the gasket strips are preferably spaced from the peripheral side walls 6c—6c of the rear member 6, so that water passage spaces 15' are provided. Any water which gains access to the interior of the cover frame or rear member will drain into the bottom of the rear member or cover frame. To provide for water drainage, the bottom vertical wall 8a' of the cover frame is provided with a series of water drainage holes 22 (see FIG. 2) and the bottom peripheral wall 6b' of the rear member is provided with a number of water drainage holes 24 also shown in FIG. 2.

Figure 12:
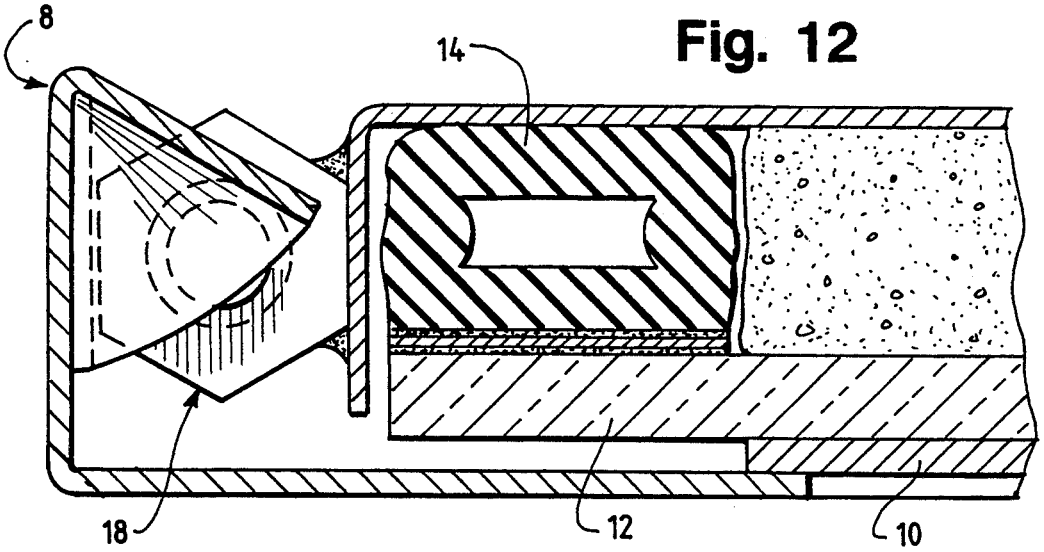
FIG. 12 is a corner sectional view of the bottom portion of the display assembly shown in FIGS. 1–10, except that the transparent panel and the poster or sign-forming sheet have been reversed in position.
Figure 13:
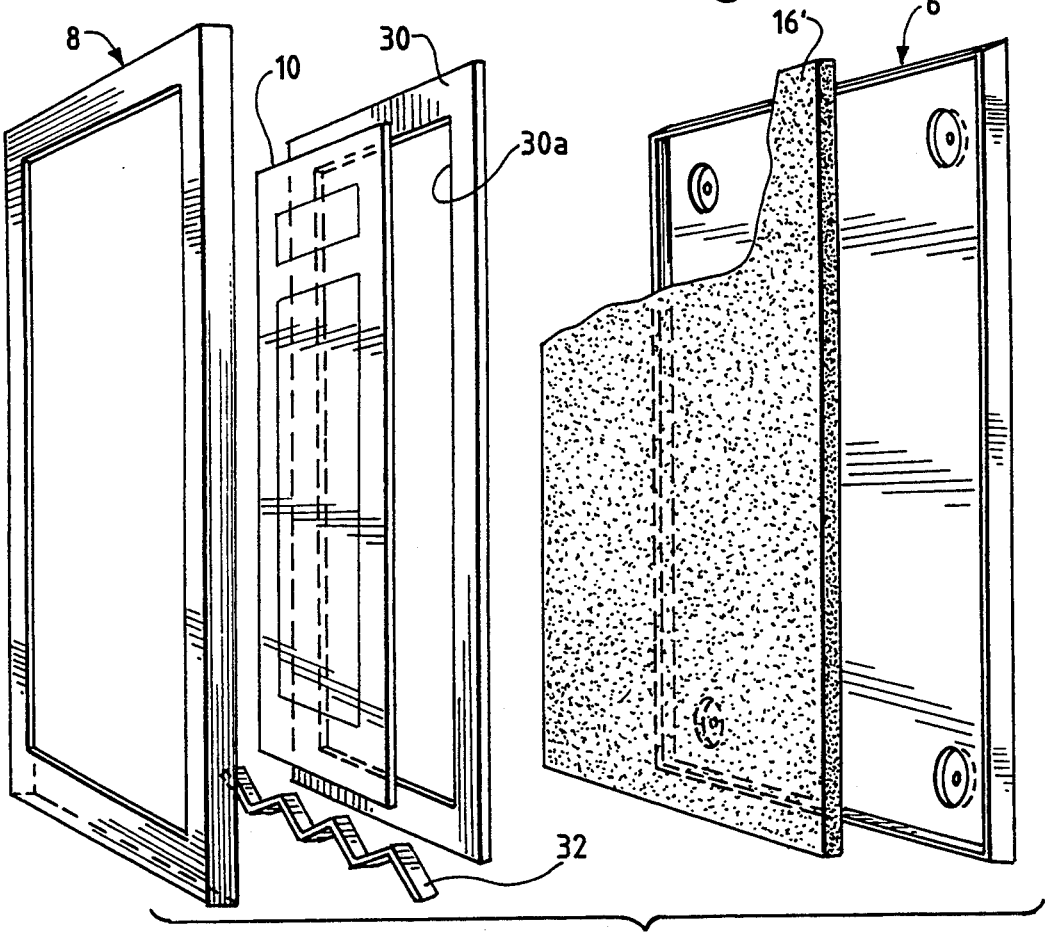
FIG. 13 is an exploded view of a modified form of the present invention where the display assembly is designed principally for indoor use.

The display assembly shown in FIGS. 1–11 is designed principally for use outdoors. However, it is possible to use that display assembly in a most effective way indoors, under circumstances where water-tight seal is not necessary. In this application of the invention where it is most desired that the sign or poster-forming sheet be directly viewed through the viewing opening of the cover frame, the position of the transparent panel 12 with the gaskets applied to the periphery thereof and the sign or poster-forming sheet 10 are reversed. FIG. 12 shows a fragmentary sectional view of such a sign assembly with these elements reversed for indoor use.

Refer now more particularly to the display sign assembly shown in FIGS. 13–17. This sign assembly generally indicated by reference numeral 2' is designed only for indoor use. It includes the same cover frame 8, the sign or poster-forming sheet 10, a larger and thicker compressible pad 16' and a rear member 6' like that utilized in the display assembly 2 previously described, except that the stationary nuts and bolts are absent and thus not attached to the rear member. They are replaced by a compressible spring metal strip 32 which fits between the top face of the bottom peripheral wall of cover frame 8 and the bottom peripheral wall of the rear member 6' in a partially compressed state. The spring-metal strip presses down on the cover frame to hold it in its lowermost position. Also, the transparent panel 12 and the gaskets 14 attached thereto are not utilized in this form of the invention. Instead, the compressible gasket 16' is made thicker and larger and there is placed in front of the compressible pad 16' a frame-forming member 30 having a rectangular aperture **30*a* therein into which the sign or poster-forming sheet 10 is placed. The frame-forming member 30 can be made of cardboard or other material. The depth of this opening 30*a* may be approximately the same as the thickness of the sheet 10**.

FIGS. 14–17 show the sequence of steps in assembling the cover frame 8 upon the rear member 6'. When the assembly of the compressible gasket 16', the frame-forming member 30 and the sign or poster-forming sheet 10 is positioned between the cover frame 8 and the rear member 6', the cover frame compresses the pad 16' so that the sign or poster-forming sheet 10 is immediately behind the front wall cover frame 8.

It should now be apparent that the present invention provides an extremely effective indoor poster or sign display assembly or a tamper-resistant and water-sealed outdoor display assembly where the display assembly is tamper-resistant and can be subjected to rain without damaging the poster or sign sheet 10. The design of the display assembly is such that it can be manufactured at a fraction of the cost of the display assembly disclosed in U.S. Pat. No. 4,583,309 and other display assemblies heretofore commercially available.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. A sealed display assembly for displaying a sign or poster sheet and mountable on a front vertical support surface, said assembly comprising, in combination:

a poster and sign-receiving rear member in the form of a pan-shaped structure including a main vertical wall having top, bottom and side margins, and top, bottom and side peripheral walls extending forwardly, respectively, to said margins to define an insertion aperture;

a front cover frame mounted over and secured to the rear member and having a front vertical wall with top, bottom and side margins and a viewing opening therein, and top, bottom and side peripheral walls extending rearwardly from respective margins of said front wall and shaped and sized to interfit with the forwardly extending peripheral walls of the rear members;

a compressible sandwich of elements between said front vertical wall of said cover frame and the vertical wall of said rear member, said compressible assembly of elements including a transparent panel mounted behind said front wall of said cover frame and behind which said sign or poster sheet is to be placed, a compressible sealing gasket along the margins of the rear surface of said panel, and a body of compressible material behind said panel and within said gasket and to be located behind said sign or poster sheet when inserted into the assembly, said compressible sealing gasket being in spaced relation to the side peripheral walls of said rear member to define water passage spaces therebetween, said bottom peripheral walls of said rear member and said cover frame having water-draining apertures where water entering said cover frame can drain from the assembly, said sealing gasket being pressed by said cover frame against said vertical wall of said rear member to form a water-sealed space enclosing said body of compressible material and said sign or poster sheet when inserted in front of said body of compressible material being pressed by said cover frame against said rear wall of said rear member so that the sign or poster sheet is held neatly in place within the display assembly.

2. The sealed display assembly of claim 1 wherein said vertical wall of said rear member is mountable upon said vertical support surface so that at least the top and bottom margins of said vertical wall will be spaced from said vertical support surface to form locking flange-receiving spaces, said cover frame interfitting with said rear member in a manner to permit initial up and down movement of said cover frame over said wall mountable member, and said sheet and body of compressible material being compressed between the front wall of said cover frame and said vertical wall of said rear member.

3. The sealed display assembly of claim 2 wherein there is provided means for locking said cover frame in said lowermost position.

4. A display assembly for displaying a sign or poster sheet and mountable on a vertical support surface, said assembly comprising, in combination:

a poster and sign sheet-receiving rear member in the form of a pan-shaped structure including a main vertical wall having top, bottom and side margins, and top, bottom and side peripheral walls extending forwardly respectively from said margins to define an insertion aperture, said vertical wall being mountable upon said vertical support surface so that at least the top and bottom margins of said vertical wall will be spaced from said vertical support surface to form locking flange-receiving spaces;

a front cover frame mounted over and around said rear member to provide a sign or poster sheet-receiving space therebetween, said cover frame having a front vertical wall with a viewing opening therein and top, bottom and side peripheral walls extending rearwardly from the margins of said front vertical wall and sized and shaped to fit around the forwardly extending peripheral walls of said rear member in a manner permitting initial up and down movement of said cover frame over said rear member, at least the top and bottom peripheral walls of said cover frame respectively having downwardly and upwardly extending locking flanges which respectively fit into said spaces, the thickness of said locking flanges being a fraction of the depth of said flange-receiving spaces, the spacing between said downwardly and upwardly extending flanges being such that the upper flange clears the upper margin of the rear member when the cover frame is in its uppermost position, and when the cover frame is in its lowermost position over said rear member, both of said locking flanges pass behind said vertical wall of said rear member so that the cover frame cannot be removed from the pan-shaped member without raising the cover frame member, and means for holding said cover frame in said lowermost position.

5. The display assembly of claim 4 wherein there is provided between said cover frame and rear member sealing means for forming a water-tight enclosure around said sheet so rain water cannot gain access to said sheet.

6. The display assembly of claim 5 wherein there is provided between said cover frame and rear member, an imperforate transparent panel behind said front wall of said cover frame and said viewing opening and behind or in front of which said sign or poster-forming sheet is to be placed, and said sealing means is a gasket compressed between said transparent panel and said vertical wall of said rear member.

7. A display assembly for displaying a sign or poster sheet and mountable on a vertical support surface, said assembly comprising, in combination:

a poster and sign sheet-receiving rear member in the form of a pan-shaped structure including a main vertical wall having top, bottom and side margins, and top, bottom and side peripheral walls extending forwardly respectively from said margins to define an insertion aperture, said vertical wall being mountable upon said vertical support surface so that at least the top and bottom margins of said vertical wall will be spaced from said vertical support surface to form locking flange-receiving spaces;

a front cover frame mounted over and around said rear member to provide a sign or poster sheet-receiving space therebetween, said cover frame having a front vertical wall with a viewing opening therein and top, bottom and side peripheral walls extending rearwardly from the margins of said front vertical wall and sized and shaped to fit around the forwardly extending peripheral walls of said rear member in a manner permitting initial up and down movement of said cover frame over said rear member, at least the top and bottom peripheral walls of said cover frame respectively having downwardly and upwardly extending locking flanges which respectively fit into said spaces, the thickness of said locking flanges being a fraction of the depth of said flange-receiving spaces, the spacing between said downwardly and upwardly extending flanges being such that the upper flange clears the upper margin of the rear member when the cover frame is in its uppermost position, and when the cover frame is in its lowermost position over said rear member, both of said locking flanges pass behind said vertical wall of said rear member so that the cover frame cannot be removed from the pan-shaped member without rasing the cover frame member, and means for holding said cover frame in said lowermost position, said holding means including a pair of stationary nuts secured to the bottom portions of the side peripheral walls of said rear member, said nuts having vertical threaded bores opening into the bottom of said nuts, and a pair of bolts having heads at the bottom ends of threaded shanks threaded upwardly respectively into the open bottom ends of said threaded bores, said bolts being unthreaded from said bores to an extent where said bolt heads press down upon the bottom peripheral wall of said rear member to hold the rear member in said lowermost position, and said bottom peripheral wall of said cover frame having tool pass-through apertures opposite the heads of said bolts, said bolt heads having tool-receiving bottom profiles to receive the mating ends of a tool insertable through said peripheral wall apertures to mate with said bolt heads to rotate the same.

8. The display assembly of claim 7 wherein each of said bolt heads have a tool head-receiving recess to receive the head of a correspondingly shaped tool passable through said pass-through apertures and a projection in the central portion of said recess to fit into an aperture in said tool head.

9. The display assembly of claim 7 wherein said side peripheral walls of said cover frame are spaced apart a distance to clear said stationary nuts, and the rear margins of said side peripheral walls terminating in inwardly extending flanges which are contiguous to the side peripheral walls of said rear member to prevent substantial lateral shifting of said cover frame.

10. The display assembly of claim 4 wherein said vertical wall of said rear member has spacer bosses projecting from the rear surface of said vertical wall to space the same from a vertical support surface, so that said flange thickness is a fraction of the depth of said spaces.

11. The display assembly of claim 10 wherein said bosses are formed by indentations in said vertical wall and said indentations have mounting screw-receiving apertures in said indentations.

12. The display assembly of claim 4 wherein said holding means includes spring means compressed between the top of the bottom peripheral wall of said cover frame and the bottom of said bottom peripheral wall of said rear member.

13. A display assembly for displaying a sign or poster sheet and mountable on a vertical support surface, said assembly comprising, in combination: a poster and sign sheet-receiving rear member in the form of a pan-shaped structure including a main vertical wall having top, bottom and side margins, and top, bottom and side peripheral walls extending forwardly respectively from said margins to define an insertion aperture, said vertical wall being mountable upon said vertical support surface so that at least the top and bottom margins of said vertical wall will be spaced from said vertical support surface to form locking flange-receiving spaces; a front cover frame mounted over and around said rear member to provide a sign or poster sheet-receiving space therebetween, said cover frame having a front vertical wall with a viewing opening therein and top, bottom and side peripheral walls extending rearwardly from the margins of said front vertical wall and sized and shaped to fit around the forwardly extending peripheral walls of said rear member in a manner permitting initial up and down movement of said cover frame over said rear member, at least the top and bottom peripheral walls of said cover frame respectively having downwardly and upwardly extending locking flanges much thinner than the depth of said flange-receiving space and which respectively fit into said spaces so that said flange thickness is a fraction of the depth of said spaces, the spacing between said downwardly and upwardly extending flanges being such that the upper flange clears the upper margin of the rear member when the cover frame is in its uppermost position, and when the cover frame is in its lowermost position over said rear member, both of said locking flanges pass behind said vertical wall of the rear member so that the cover frame cannot be removed from the pan-shaped member without raising the cover frame member; means for holding said cover frame in said lowermost position; and a compressible sandwich of elements between said front vertical wall of said cover frame and the vertical wall of said rear member, said compressible sandwich of elements including a compressible pad in front of said rear member and a compressible frame-forming body of material in front of said pad and defining a recess for receiving said sign or poster sheet, and said pad and compressible frame-forming body being pressed by said cover frame against and toward said rear wall of said rear member so that the sign or poster sheet is held neatly in place within the display assembly.

14. A kits of parts from which a framed sealed structure for displaying a sign or poster sheet can be constructed and mounted on a vertical support surface, said kit comprising:

a rear member in the form of a pan-shaped structure including a main vertical wall having top, bottom and side margins, and top, bottom and side peripheral walls extending forwardly from said respective margins to define an insertion aperture, a front cover frame mountable over and around said rear member and having a front vertical wall with top, bottom and side margins and a viewing opening therein, and top, bottom and side peripheral walls extending rearwardly from side margins of said vertical wall and sized and shaped to interfit around the forwardly extending peripheral walls of said rear member;

an imperforate transparent panel mountable behind said front wall of said cover frame and said viewing opening;

a compressible sealing gasket extendable along the marginal portions of the rear face of said vertical transparent panel, said sealing gasket to enclose a seal space to receive a poster or sign-forming sheet, said compressible sealing gasket being in spaced relation to the side peripheral walls of said rear member to define water passage spaces therebetween, said bottom peripheral walls of said rear member and said cover frame having water-draining apertures where water entering said cover frame can drain from the assembly, and a body of compressible material placeable in said space between the rear face of a sign or poster sheet and said vertical wall of said rear member, the overall thickness of said transparent panel, sealing gasket, poster or sign sheet and body of compressible material being such that, when assembled together as a sandwich and positioned between the rear face of the front wall of said cover frame and the front face of said vertical wall of said rear member and the cover frame is interlocked with said rear member, the sealing gasket is compressed into sealing relation with the front face of said vertical wall of said rear member and said sign or poster sheet of compressible material respectively sandwiched between and pressed toward and against the front face of said vertical wall of said rear member within the sealed, spaced and formed by said sealing gasket.

15. A kit for forming a displaying assembly for sign or sheet posters outdoors and mountable on a vertical support surface, said assembly comprising:

a poster and sign sheet-receiving rear member in the form of a pan-shaped structure including a main vertical wall having top, bottom and side margins, and top, bottom and side peripheral walls extending forwardly respectively from said margins to define an insertion aperture, said vertical wall being mountable upon said vertical support surface so that at least the top and bottom margins of said vertical wall will be spaced from said vertical support surface to form locking flange-receiving spaces; and a front cover frame mountable over and around said rear member to provide a sign or poster sheet-receiving space therebetween, said cover frame having a front vertical wall with a viewing opening therein and top, bottom and side peripheral walls extending rearwardly from the margins of said front vertical wall and sized and shaped to fit around the forwardly extending peripheral walls of said rear member in a manner permitting initial up and down movement of said cover frame over said rear member, at least the top and bottom peripheral walls of said cover frame respectively having downwardly and upwardly extending locking flanges having a thickness which are a fraction of the depth of said flange-receiving space so that they can fit with a loose clearance into said flange-receiving spaces between said vertical support surface and the vertical wall of said rear member, the spacing between said downwardly and upwardly extending flanges being such that when the cover frame is in its lowermost position over said rear member, said locking flanges pass behind said vertical support surface so that the cover frame cannot be removed from the pan-shaped member without raising the cover frame member.

16. The kit of claim 15 further including an imperforate transparent panel mountable behind said front wall of said cover frame and said viewing opening and in front or behind which a sign or poster-forming sheet is to be mounted; and sealing means for forming a water-tight enclosure along at least the margins of the rear side of said panel, said sheet so rain water cannot gain access to said sheet.

17. The kit of claim 16 wherein said sealing means is a gasket compressible between said transparent panel and said vertical wall of said rear member and enclosing a space within which said poster or sign-forming sheet is to be placed.

18. The kit of claim 15 wherein there is provided means for locking said cover frame in said lowermost position.

19. The kit of claim 15 wherein said vertical wall of said rear member has spacer bosses projecting from the rear surface of said vertical wall to space the same from said vertical support surface.

20. The kit of claim 16 wherein said indentations have mounting screw-receiving apertures in said indentations.

21. A kit for forming a displaying assembly for sign or sheet posters outdoors and mountable on a vertical support surface, said assembly comprising:

a poster and sign-receiving rear member in the form of a pan-shaped structure including a main vertical wall having top, bottom and side margins, and top, bottom and side peripheral walls extending forwardly respectively from said margins to define an insertion aperture, said vertical wall being mountable upon said vertical support surface so that at least the top and bottom margins of said vertical wall will be spaced from said vertical support surface to form locking flange-receiving spaces;

a front cover frame mountable over and around said rear member to provide a sign or poster sheet-receiving space therebetween, said cover frame having a front vertical wall with a viewing opening therein and top, bottom and side peripheral walls extending rearwardly from the margins of said front vertical wall and sized and shaped to fit around the forwardly extending peripheral walls of said rear member in a manner permitting initial up and down movement of said cover frame over said rear member, at least the top and bottom peripheral walls of said cover frame respectively having downwardly and upwardly extending locking flanges which respectively can fit with a loose clearance into said flange-receiving spaces between said vertical support surface and the vertical wall of said rear member, the spacing between said downwardly and upwardly extending flanges being such that when the cover frame in its lowermost position over said rear member, said locking flanges pass behind said vertical support surface so that the cover frame cannot be removed from the pan-shaped member without raising the cover frame member; and a compressible pad insertable in front of said rear member and a compressible frame-forming body of material, insertable in front of said pad and defining a recess for receiving said sign or poster sheet and said pad and compressible frame-forming body being pressible by said cover frame against said rear wall of said rear member so that the sign or poster sheet is held neatly in place within the display assembly.

* * * * *